United States Patent [19]

Imai et al.

[11] Patent Number: 4,525,420

[45] Date of Patent: Jun. 25, 1985

[54] POLYURETHANE ELASTIC YARNS AND THEIR PRODUCTION

[75] Inventors: Fusao Imai; Norio Okumura, both of Tsuruga, Japan

[73] Assignee: Toyo Boseki Kabushiki Kaisha, Japan

[21] Appl. No.: 535,443

[22] Filed: Sep. 22, 1983

[30] Foreign Application Priority Data

Sep. 22, 1982 [JP] Japan ..... 57-165469

[51] Int. Cl.[3] ..... D02G 3/00

[52] U.S. Cl. ..... 428/372; 428/364; 428/373

[58] Field of Search ..... 428/372, 375, 391, 394, 428/364, 373; 524/590, 874, 875, 449, 450, 451, 447, 425, 423, 424, 430, 409, 433

[56] References Cited

U.S. PATENT DOCUMENTS

| | | | |
|---|---|---|---|
| 3,009,901 | 11/1961 | Frazer | 524/874 X |
| 3,097,192 | 7/1963 | Schilit | 524/874 X |
| 3,536,663 | 10/1970 | Bertel et al. | 524/874 X |
| 4,296,174 | 10/1981 | Hanzel et al. | 428/372 X |
| 4,340,527 | 7/1982 | Martin | 524/590 |
| 4,352,906 | 10/1982 | Reed et al. | 524/590 X |
| 4,439,577 | 3/1984 | O'Connor et al. | 524/874 |

*Primary Examiner*—Lorraine T. Kendell

*Attorney, Agent, or Firm*—Jones, Tullar & Cooper

[57] ABSTRACT

A polyurethane elastic yarn, characterized in that an inorganic filler having a refractive index ($n_D^{20°\,C.}$) of not more than 1.75 is contained therein in an amount of not less than 0.2% by weight. The elastic yarn is improved in spinning property and also in light resistance and chlorine resistance.

7 Claims, No Drawings

POLYURETHANE ELASTIC YARNS AND THEIR PRODUCTION

The present invention relates to polyurethane elastic yarns and their production. More particularly, it relates to polyurethane elastic yarns improved in spinning operation efficiency as well as various physical properties such as light resistance and chlorine resistance, and their production.

Usually, polyurethane elastic yarns are incorporated with titanium oxide in a content of not less than 1% by weight. These elastic yarns are used for the manufacture of knitted products (e.g. tricot power net, tricot satin net), the formation of the elastic band portions in socks, etc. While the elastic yarns are hardly dyeable in deep color, they are so exposed in white when any product incorporated therewith is expanded that the commercial appearance of such a product is deteriorated. In order to make them dyeable in deep color, the introduction of a tertiary nitrogen atom into the molecular chain of a polyurethane, the blending of a tertiary nitrogen atom-containing compound into a polyurethane. etc. have been proposed. However, the production of a polyurethane having a tertiary nitrogen atom in the molecule is not easy. On the other hand, a tertiary nitrogen atom-containing compound is apt to stain the filament passage so as to lower the spinning operation efficiency with deterioration of the reeling property. Further, it attaches onto the knitting needles as well as the rollers at the knitting step so that the operation efficiency is markedly deteriorated.

When titanium oxide is not incorporated, the elastic yarns are enhanced in transparency, and their exposure from any product incorporated therewith is not noticeable. However, as a result of not using titanium oxide having a high hiding power, the transmission of light is much increased, and the light resistance is thus deteriorated.

As a result of an extensive study, it has now been found that the incorporation of a certain specific inorganic filler into a polyurethane elastic yarn not only enhances the spinning operation efficiency but also improves various physical properties. Particularly notable is that the transparency of the elastic yarn is increased and the exposure of the elastic yarn on the expansion of any product comprising the same becomes unnoticeable, and the commercial value of such a product is thus not deteriorated. Advantageously, the light resistance is not lowered in spite of the increased transparency.

According to the present invention, there is provided a polyurethane elastic yarn having the advantageous properties as stated above, which contains at least one inorganic filler of not more than 1.75 in refractive index ($n_D^{20°\,C.}$) in an amount of not less than 0.2% by weight based on the elastic yarn.

The polyurethane elastic yarn of the invention is characteristic in comprising an inorganic filler having a small refractive index. It is of clear type and has high transparency. When an inorganic filler, of which the refractive index is slightly different from that of the polyurethane, is used, the reflection of light is diffused so that the light absorption into the inside of the elastic yarn is prevented, and a good light resistance is thus maintained. Depending upon the kind of the inorganic filler, any additional effect such as increase of chlorine resistance can be expected. Since the specific gravity is increased by incorporation of the inorganic filler, the turbulence and melt adhesion of the filaments due to gas stream in a spinning tube can be prevented so that the breaking of the filaments is much decreased. Thus, the operation efficiency on spinning is highly enhanced. In addition, the incorporation of the inorganic filler contributes in lowering of the cost of the elastic yarn.

The polyurethane may be, for instance, a polymer prepared from a polymeric diol having a molecular weight of not less than 600, preferably of 1000 to 5000, and a melting point of not higher than 60° C., an organic diisocyanate and a bifunctionally active hydrogen compound having a molecular weight of not more than 400 in a conventional manner.

Examples of the polymeric diol are polyether glycols (e.g. polytetramethylene ether glycol, polyethylene propylene ether glycol), polyester glycols formed by the reaction between a glycol (e.g. ethylene glycol, 1,4-butanediol, neopentyl glycol, 1,6-hexanediol) and a dicarboxylic acid (e.g. adipic acid, suberic acid, azelaic acid, sebacic acid, beta-methyladipic acid, isophthalic acid), polycaprolactone glycol, polyhexamethylene dicarbonate glycol, etc. One or more chosen from these polymeric diols may be employed.

Examples of the organic diisocyanate are 4,4'-diphenylmethane diisocyanate, 1,5-naphthalene diisocyanate, 1,4-phenylene diisocyanate, 2,4-tolylene diisocyanate, hexamethylene diisocyanate, 1,4-cyclohexane diisocyanate, 4,4'-dicyclohexylmethane diisocyanate, isophorone diisocyanate, etc. These organic diisocyanates may be employed alone or in combination.

As the bifunctionally active hydrogen compound, there are exemplified ethylene diamine, 1,2-propylene diamine, hexamethylene diamine, xylylene diamine, 4,4'-diphenylmethane diamine, hydrazine, 1,4-diaminopiperazine, ethylene glycol, 1,4-butanediol, 1,6-hexanediol, water, etc. These may be used alone or in combination. Among them, preferred is the one chosen from diamines.

Usually, the preparation of the polyurethane is accomplished by reacting a polymeric diol with an organic diisocyanate in a molar ratio of 1:1.5—3 in the presence or absence of an inert solvent to make a prepolymer having an isocyanate group at each of both terminal positions, followed by reacting the prepolymer in a solution state with a bifunctionally active hydrogen compound for chain extension to make a solution of the polyurethane. As the solvent for the polyurethane, there may be exemplified N,N-dimethylformamide, N,N-dimethylacetamide, tetramethylurea, hexamethylphosphoramide, etc.

The manner for preparation of the polyurethane is not important in the present invention. Thus, the preparation may be alternatively accomplished by any other conventional manner, for instance, reacting a polymeric diol with an organic diisocyanate and a bifunctionally active hydrogen compound simultaneously. Further, those starting materials may be subjected to the said reactions in portions and at several steps.

As the inorganic filler having a refractive index ($n_D^{20°\,C.}$) of not more than 1.75, there may be exemplified silicates (e.g. clay, calcined clay, talc, Canadian mica, mica, wollastonite, vermiculite, calcium silicate, feldspar, terra alba, pyrophyllite, sericite, bentonite, glass flake, glass powder), carbonates (e.g. calcium carbonate, barium carbonate, magnesium carbonate, complex carbonate), sulfates (e.g. barium sulfate, calcium sulfate), metal oxides (e.g. alumina, antimony trioxide, magnesia), etc. These inorganic fillers are usually and materially insoluble in the polyurethane solvent and water. Among them, preferred are carbonates, sulfates, silicates, etc., especially carbonates and sulfates, of alkaline earth metals belonging to Group IIa in the periodic table. The most preferred is barium sulfate.

The inorganic filler has usually a particle size of 0.01 to 100 microns, preferably of not more than 20 microns, more preferably of not more than 5 microns. For preparation of such fine particles, there may be employed any conventional pulverizer such as an attritor ball mill or a sand grinder.

The amount of the inorganic filler to be incorporated into the polyurethane is varied with the kind, the particle size, the specific gravity, etc. The use of a larger amount is favorable for lowering the cost of the resulting elastic yarn. But, an excessive amount deteriorates the characteristic performances of the elastic yarn. Accordingly, the inorganic filler is normally employed in an amount of 0.2 to 10% by weight, preferably of 0.5 to 10% by weight, more preferably of 2 to 8% by weight based on the weight of the elastic yarn. However, a larger amount than the said upper limit may be used for the purpose of improvement of spinning operation efficiency, light resistance and chlorine resistance.

When the refractive index is kept below 1.75, the resulting polyurethane elastic yarn is of clear type. The small difference of the refractive index of the inorganic filler from that of the polyurethane (1.43–1.53) makes the reflection diffused so that the absorption of light into the inside of the elastic yarn is inhibited, and the light resistance is thus increased. From this viewpoint, the refractive index of the inorganic filler is favorably to be from 1.60 to 1.75. The refractive index of more than 1.75 results in the loss of the characteristic performances of clear type. For prevention of the turbulance of the filaments due to the stream in a spinning tube as well as improvement of the spinning operation efficiency, the specific gravity of the inorganic filler is preferred to be not less than 2.

The elastic yarn of the invention can be obtained by incorporating the inorganic filler into the reaction system for production of the polyurethane or into the polyurethane before spinning and subjecting the polyurethane containing the inorganic filler to spinning. Especially preferred is to incorporate the inorganic filler into the polyurethane or a solvent for the polyurethane and to prepare the elastic yarn by dry spinning.

The polyurethane elastic yarn of the invention may comprise, in addition to the polyurethane and the inorganic filler, any conventional additive(s) such as hindered phenols, hindered amines, ultraviolet ray absorbers, discoloration inhibitors, metal soaps, etc. These may be used alone or in combination. Further, the incorporation into the polyurethane may be effected simultaneously with or separately from the inorganic filler. A typical example of the additive is an anti-fungal agent such as pyridine-2-thiol-1-oxide sodium salt or bis-1-hydroxypyridine-2-thionate zinc complex, and the incorporation of such anti-fungal agent is effective in not only imparting anti-fungal activity to the elastic yarn but also improving the breaking property of the elastic yarn.

Usually, dry spinning of a polyurethane is carried out at a temperature of 150 to 250° C., and the monofilament denier is normally from 5 to 15 denier. The spun filaments are temporarily twisted, and an oiling agent is applied thereto. While any limitation is not present on the kind of the oiling agent, preferred oiling agents are mineral oils, dimethylpolysiloxane, diorganopolysiloxanes resulting from the replacement of at least one methyl group in dimethylpolysiloxane by other alkyl or phenyl, modified polysiloxanes resulting from the introduction of epoxy, amino, vinyl, etc. into dimethylpolysiloxane, polysiloxanes bearing a perfluoroalkyl group, polyether-modified polysiloxanes, etc. More preferred is an oiling agent comprising at least one of said silicones and a mineral oil with or without any conventional additive as stated above therein.

Practical and presently preferred embodiments of the invention are illustratively shown in the following exmaples wherein part(s) and % are by weight unless otherwise indicated. The test methods as adopted in the examples are as follows:

(1) Color difference expression

As described in JIS (Japan Industrial Standards) Z8730-1980.

(2) Light resistance (resistance to discoloration)

Yarns (1 gram) are wound up around an aluminum plate of 25 mm long and 45 mm wide in a nearly parallel state, and half is covered with an aluminum foil. After irradiation with a fade-o-meter for 20, 40 or 60 hours, the difference between the color phases at the irradiated portion and at the non-irradiated portion (i.e. the portion covered by the aluminum foil) of the yarns is measured according to the method as described in JIS Z8730, and the result is indicated by the $\Delta b$ value, which is the difference between the b values at the irradiated portion and at the non-irradiated portion.

(3) Light resistance (resistance to deterioration)

Several yarns are bonded onto a cardboard of 45 mm wide and 300 mm long in a nearly parallel state, and irradiation is made thereon with a fade-o-meter for 20, 40 or 60 hours. The yarns are taken out and subjected to measurement of residual strength by the aid of a tensile tester with constant rate of specimen extension (manufactured by Toyo-Baldwin). The resistance to deterioration is calculated according to the following equation:

$$\text{Resistance to deterioration} = \frac{\text{Strength of yarn after irradiation}}{\text{Strength of yarn before irradiation}} \times 100\ (\%)$$

(4) Chlorine resistance

Yarns (about 1 gram) taken up on a hank are immersed in circulating tap water for 12, 24, 48 or 72 hours. Then, the yarns are dried at 105° C. for 2 hours, and the residual strength is measured by the aid of a tensile tester with constant rate of specimen extension. The chlorine resistance is calculated according to the following equation:

$$\text{Resistance to chloride} = \frac{\text{Strength of yarn after immersion}}{\text{Strength of yarn before immersion}} \times 100\ (\%)$$

5) Spinning operability

Several spinnerets, of which each has five holes, are set onto a spinning tube. Through this tube, dry spinning is carried out with a spinning rate of 500 m/min, and the spun filaments are twisted temporarily to make a yarn of 40 denier. Spinning is effected under the above conditions for 7 days. The results are indicated by the times of yarn breakage per 100 spindles in one day.

EXAMPLE 1

Polytetramethylene ether glycol having a hydroxyl group at each of both terminal positions (molecular weight, 2000) and 4,4'-diphenylmethane diisocyanate were reacted in a molar ratio of 1 : 2 to give a prepolymer, which was then reacted with 1,2-propylene diamine for chain extension to give a polyurethane solution having a viscosity of 2000 poise at a polymer concentration of 30%.

To the polyurethane solution, an inorganic filler (average particle size, 0.1 to 2 microns) chosen from aluminum silicate (hydrate), magnesium silicate, calcium carbonate, barium carbonate, magnesium carbonate, barium sulfate, calcium sulfate, aluminum oxide, antimony trioxide and magnesium oxide, and pulverized in an attritor was added in an amount of 2% based on the weight of the polyurethane, and small amounts of an antioxidant ("Ionox 330" manufactured by Shell Oil Co.; hindered phenol type), a ultra-violet ray absorber ("Tinuvin 328" manufactured by Ciba Geigy Co.; benzotriazole type) and a discoloration inhibitor (adduct of bisphenol A diglycidyl ether (1 mol) and dimethylhydrazine (2 mol)) were further added thereto. The resulting mixture was stirred well to make a spinning solution.

The spinning solution was defoamed in vacuo and extruded through a nozzle having five holes (each hole having a diameter of 0.2 mm) into a spinning cylinder with a stream of heated air. The resulting filaments were temporarily twisted at 10,000 rpm and taken up with a spinning rate of 500 m/min while applying an oiling agent comprising dimethylpolysiloxane as the major component thereto in an amount of 6% based on the weight of the filaments to give a polyurethane elastic yarn comprising the inorganic filler of 40 denier.

For comparison, a polyurethane elastic yarn not comprising an inorganic filler was prepared in the same manner as above but not using an inorganic filler.

The polyurethane elastic yarns as obtained above were subjected to measurements of color difference, light resistance (resistance to discoloration and resistance to deterioration), chlorine resistance and spinning operation efficiency. The results are shown in Table 1.

TABLE 1

| Inorganic filler | | Aluminum silicate | Magnesium silicate | Calcium carbonate | Barium carbonate | Magnesium carbonate | Barium sulfate | Calcium sulfate | Aluminum oxide | Antimony trioxide | Magnesium oxide | Comparative |
|---|---|---|---|---|---|---|---|---|---|---|---|---|
| Refractive index ($n_D^{20°C.}$) | | 1.66 | 1.64 | 1.66 | 1.53 | 1.501 | 1.64 | 1.576 | 1.61 | 1.75 | 1.74 | — |
| Specific gravity | | 2.63 | 3.25 | 2.71 | 4.43 | 2.20 | 4.46 | 2.96 | 3.8 | 5.19 | 3.65 | — |
| Color hue | | Grayish white | White | White | White | White | White | White | White | White | White | — |
| Water solubility (20° C., mg/100 g) | | 0 | 0 | 1.5 | 6.5 | 152 | 115 | 223 | 0 | 160 | 0.62 | — |
| Color hue | L | 85.0 | 85.3 | 86.2 | 88.7 | 89.8 | 85.3 | 89.0 | 86.2 | 82.6 | 83.5 | 85.3 |
| | a | −0.9 | −0.5 | −0.7 | +1.5 | +1.6 | −0.8 | +1.5 | −0.4 | −1.6 | −1.5 | −0.3 |
| | b | 7.3 | 5.0 | 4.1 | 5.3 | 5.0 | 5.2 | 4.9 | 5.0 | 5.2 | 5.1 | 4.8 |
| Resistance to discoloration (Δb) | 40 hrs | 1.20 | 1.35 | 1.18 | 1.80 | 1.75 | 1.15 | 1.55 | 1.40 | 1.00 | 1.05 | 1.75 |
| | 60 hrs | 2.40 | 1.80 | 1.65 | 2.46 | 2.55 | 1.75 | 1.93 | 1.80 | 1.20 | 1.25 | 2.45 |
| Resistance to deterioration (%) | 20 hrs | 75 | 71 | 75 | 70 | 68 | 75 | 65 | 68 | 85 | 83 | 70 |
| | 40 hrs | 56 | 55 | 58 | 41 | 40 | 56 | 50 | 53 | 65 | 67 | 40 |
| | 60 hrs | 40 | 40 | 43 | 20 | 13 | 41 | 35 | 38 | 45 | 43 | 6 |
| Chlorine resistance (%) | 12 hrs | 34 | 36 | 55 | 35 | 35 | 37 | 45 | 36 | 37 | 36 | 36 |
| | 24 hrs | 14 | 15 | 33 | 14 | 13 | 12 | 32 | 15 | 13 | 13 | 14 |
| | 36 hrs | 11 | 12 | 28 | 10 | 11 | 9 | 22 | 9 | 8 | 10 | 10 |
| | 48 hrs | 6 | 7 | 23 | 4 | 6 | 5 | 20 | 5 | 6 | 4 | 5 |

From the above results, it is understood that when the refractive index of the inorganic filler is from 1.50 to 1.70, the color hue of the elastic yarn comprising the inorganic filler is nearly equal to that of the elastic yarn not comprising the inorganic filler. The discoloration due to light increases with a larger Δb value. With a larger difference of the refractive index of the inorganic filler from that of the polyurethane which is normally within a range of 1.43 to 1.53, the discoloration due to light becomes smaller. The deterioration due to light shows a similar tendency to the above. Taking such tendency of the light resistance into consideration, the refractive index of the inorganic filler is preferred to be from 1.60 to 1.70.

The use of calcium carbonate or calcium sulfate as the inorganic filler can advantageously and additionally improve the chlorine resistance, although the reason therefor is still unclear.

EXAMPLE 2

In the same manner as, in Example 1, a polyurethane solution was prepared, a pulverized barium carbonate (average particle size, 0.1 micron) as pulverized was incorporated therein in an amount of 0.1, 1.0, 4 or 8% based on the polyurethane together with other additives to make a spinning solution. For comparison, a spinning solution not comprising barium carbonate was prepared in the same manner as above.

Each of the spinning solutions as prepared above was extruded through a spinneret holder comprising several spinnerets (each having 5 holes) into a spinning cylinder with a stream of heated air. The resultant filaments were temporarily twisted and taken up with a spinning rate of 500 m/min while applying an oiling agent comprising dimethylpolysiloxane as the major component thereto to make a polyurethane elastic yarn of 40 denier. Doffing was carried out with a winding of 400 grams and a pitch of 180 minutes. The operation was continued for seven consecutive days. The times of yarn breaking and the yarn quality were examined on 100 spindles per day. The results are shown in Table 2.

TABLE 2

| | Added amount of barium carbonate (%) | | | | |
|---|---|---|---|---|---|
| | 0.1 | 1.0 | 4 | 8 | Comparative |
| Spinning operation efficiency (times/day) | 3.61 | 1.68 | 0 | 0 | 3.55 |
| Strength (g) | 61 | 59 | 58 | 50 | 61 |
| Elongation (%) | 456 | 453 | 451 | 425 | 455 |
| Stress at 300% elongation (g) | 19.0 | 19.0 | 19.1 | 21.1 | 18.9 |

From the above results, it is understood that the incorporation of barium carbonate in an amount of 0.1% is not effective in improvement of the spinning operation efficiency but that in an amount of not less than 1%, particulrly of not less than about 4%, produces remarkable improvement in spinning operation efficiency. When the amount is increased to such a large amount as 8%, the content of the polymer is lowered with decrease of strength and elongation, and the stress at 300% elongation is rapidly increased.

EXAMPLE 3

Methylene bis(4-phenylisocyanate) (10 parts) and polyester glycol (molecular weight, 6000) (80 parts) were reacted at 80° C. for 60 minutes to give a prepolymer. The prepolymer was dissolved in dimethylformamide (213 parts) at 5° C. and then reacted with 1,2-propylene diamine (1.4 parts) for chain extension.

To the resultant viscous polyurethane solution (viscosity at 20° C., 1200 poise), a slurry of barium sulfate in dimethylformamide was added in an amount of 3% (as barium sulfate) based on the weight of the polyurethane to make a spinning solution.

For comparison, another spinning solution was prepared in the same manner as above but barium sulfate was not incorporated therein.

Each of the spinning solutions as prepared above was defoamed in vacuo and extruded through a spinneret having 5 holes (each hole having a diameter of 0.3 mm) into a stream of air heated at 250° C. to make filaments. When the solvent content became less than 0.5%, the filaments were temporarily twisted at 10,000 rpm and taken up while applying an oiling agent comprising dimethylpolysiloxane as the major component thereto in an amount of a 6% based on the weight of the filaments to make a polyurethane elastic yarn of 60 denier.

The thus obtained elastic yarns were subjected to measurements of color hue, light resistance and chlorine resistance. The results are shown in Table 3.

TABLE 3

| | | Barium sulfate | Comparative |
|---|---|---|---|
| Color hue | L | 86.2 | 85.2 |
| | a | −0.2 | −0.9 |
| | b | 5.1 | 6.9 |
| Resistance to discoloration (Δb) | 40 hrs | 2.5 | 5.5 |
| | 60 hrs | 11.2 | 15.2 |
| Resistance to deterioration (%) | 20 hrs | 91 | 82 |
| | 40 hrs | 73 | 48 |
| | 60 hrs | 42 | 15 |
| Chlorine resistance (%) | 12 hrs | 91 | 92 |
| | 24 hrs | 83 | 77 |
| | 36 hrs | 61 | 42 |
| | 48 hrs | 53 | 33 |

From the above results, it is understood that the polyurethane elastic yarn comprising barium sulfate is not different from that not comprising barium sulfate in color hue, while the former is remarkably improved in light resistance and chlorine resistance.

What is claimed is:

1. A polyurethane elastic yarn containing in the polyurethane composition thereof an inorganic filler chosen from carbonates and sulfates of alkaline earth metals belonging to Group II a of the periodic table, said filler comprising from 0.2 to 10% by weight based on the weight of the elastic yarn and having a refractive index ($n_D^{20° C.}$) of not more than 1.75.

2. The polyurethane elastic yarn according to claim 1, wherein the content of the inorganic filler is 2 to 8% by weight.

3. The polyurethane elastic yarn according to claim 1, wherein the inorganic filler has a refractive index of 1.60 to 1.75.

4. The polyurethane elastic yarn according to claim 1, wherein the inorganic filler has a specific gravity of not less than 2.

5. The polyurethane elastic yarn according to claim 2 further wherein the inorganic filler has a refractive index of 1.60 to 1.75.

6. The polyurethane elastic yarn according to claim 2 further wherein the inorganic filler has a specific gravity of not less than 2.

7. The polyurethane elastic yarn according to claim 3 further wherein the inorganic filler has a specific gravity of not less than 2.

* * * * *